US007974424B2

(12) United States Patent
Kushida et al.

(10) Patent No.: US 7,974,424 B2
(45) Date of Patent: Jul. 5, 2011

(54) SPEAKER ARRAY SYSTEM

(75) Inventors: Koji Kushida, Hamamatsu (JP); Takashi Yamakawa, Iwata (JP)

(73) Assignee: Yamaha Corporation (JP)

( * ) Notice: Subject to any disclaimer, the term of this patent is extended or adjusted under 35 U.S.C. 154(b) by 263 days.

(21) Appl. No.: 12/262,680

(22) Filed: Oct. 31, 2008

(65) Prior Publication Data

US 2009/0110219 A1 Apr. 30, 2009

(30) Foreign Application Priority Data

Oct. 31, 2007 (JP) ..... 2007-283567

(51) Int. Cl.
*H04R 5/02* (2006.01)
*H04R 5/00* (2006.01)

(52) U.S. Cl. ..... 381/303; 381/304; 381/300; 381/1; 381/17; 381/18

(58) Field of Classification Search ..... 381/1, 17–19, 381/300, 303–306
See application file for complete search history.

(56) References Cited

U.S. PATENT DOCUMENTS 5,953,432 A * 9/1999 Yanagawa et al. ..... 381/335
2006/0210093 A1 * 9/2006 Ishibashi et al. ..... 381/80

FOREIGN PATENT DOCUMENTS

JP 2006-109343 A 4/2006

* cited by examiner

*Primary Examiner* — Devona E Faulk
(74) *Attorney, Agent, or Firm* — Rossi, Kimms & McDowell LLP

(57) ABSTRACT

A speaker array system for outputting, with a simplified construction, sounds audible with a nearly uniform sound volume within an arbitrarily set area. The speaker array system includes a speaker array having speaker units, a delay unit for supplying the speaker units with delayed audio signals generated by adding delays to an input audio signal, an input unit for inputting area information representing a target area to which an acoustic service is provided using an acoustic beam emitted from the speaker array and which has a normal line extending in a direction different from a normal direction of a speaker surface of the speaker array, and a control unit for calculating delays to be applied to the delay unit. Based on the delays, acoustic waves output from adjacent ones of the speaker units toward the target area are made coincident with each other and an envelope is more distorted from a spherical surface so as to face the target area as the envelope propagates closer to the target area.

5 Claims, 11 Drawing Sheets

SPEAKER ARRAY SYSTEM

BACKGROUND OF THE INVENTION

1. Field of the Invention

The present invention relates to a speaker array system having a speaker array comprised of speaker units for emitting an acoustic beam.

2. Description of the Related Art

As a speaker array system of this type, there is a speaker array system of delay array type (see, for example, paragraph 0004 and FIG. 9 of Japanese Laid-open Patent Publication No. 2006-109343). In such a speaker array system of delay array type, delay amounts of audio signals supplied to speaker units of a speaker array are adjusted for control of a sound field and a directivity characteristic of acoustic waves emitted from the speaker array. For example, delays determined based on differences between paths extending from a virtual acoustic center to the speaker units are applied to the audio signals for the speaker units, whereby sound can be reproduced as if it were emitted isotropically from an acoustic source at the virtual acoustic center and spread out in a spherical wave.

FIG. 15 shows how acoustic waves (hereinafter referred to as wavelets), which are output from the speaker units of the speaker array system of delay array type are superposed on one another. In FIG. 15, rmin represents the length of a path from an acoustic center to an uppermost speaker, ri represents the length of a path from the acoustic center to a lowermost speaker, and a path difference ri-rmin corresponds to a delay. With the speaker array system of delay array type, the dense degree of wavelet superposition varies depending on directions of acoustic wave propagation, as shown in FIG. 15. The sound pressure becomes higher at a place where the wavelets are more densely superposed on one another. With the speaker array system of delay array type, therefore, the strength of sound listened to by an audience varies in dependence on a positional relation between the audience and the speaker array. Thus, the speaker array system of delay array type has a drawback that it cannot realize an acoustic service that provides nearly uniform sound volume to any area having arbitrary shape and size (i.e., emission of an acoustic beam that produces sound listenable to at a nearly uniform sound volume in any position in the area).

SUMMARY OF THE INVENTION

The present invention provides a speaker array system capable of emitting, with a simple construction, an acoustic beam that generates sound listenable to at a nearly uniform sound volume at any place in any area having an arbitrary shape and size.

According to the present invention, there is provided a speaker array system comprising a speaker array in which a plurality of speaker units are arranged, a delay unit adapted to add delays respectively corresponding to the speaker units to an input audio signal to thereby generate delayed audio signals corresponding in number to the speaker units and adapted to supply the delayed audio signals to the speaker units, an input unit adapted to be used for input of area information representing a target area to which an acoustic service is provided using an acoustic beam generated by acoustic waves output from the speaker units of the speaker array, the target area having a normal line extending in a direction different from a normal direction of a speaker surface of the speaker array, and a control unit adapted to provide the delays to the delay unit based on arrangement positions of the speaker units in the speaker array and the area information, the delays being such that an envelope of wavefronts of the acoustic waves output from the speaker units is made to be an aspherical surface, the acoustic waves output from adjacent ones of the speaker units in the speaker array toward the target area are made coincident in phase with each other, and the envelope is more distorted from a spherical surface so as to face the target area as the envelope propagates closer to the target area.

According to the speaker array system of this invention, an acoustic beam is emitted toward the target area such that acoustic waves (i.e., wavelets) output from adjacent speaker units in the speaker array toward the target area are coincident in phase with one another and the wavefront of the acoustic beam is more distorted so as to face the target area as it propagates closer to the target area. Since the wavefront of the acoustic beam emitted by the speaker array system of this invention toward the target area is more distorted to face the target area as it propagates closer to the target area, a sound pressure distribution can be made more nearly uniform as compared to the conventional speaker array of delay array type for emitting an acoustic beam having a spherical wavefront.

The speaker units of the speaker array can be arranged in a line, the control unit can carry out first to fourth processes, the first process can be for setting a cover area, which is a target arrival area of the acoustic beam, so as to cover the target area based on the area information and for setting target arrival points of the acoustic waves from the speaker units to the cover area in accordance with arrangement positions of the speaker units in the speaker array, the second process can be for determining intersections between first straight lines and second straight lines, each of the first straight lines passing though the arrangement position and the target arrival point for a corresponding one of the speaker units, each of the second straight lines passing through the arrangement position and the target arrival point for another corresponding one of the speaker units which is the largest next to the corresponding one of the speaker units in terms of distance from the cover area, the third process can be for determining paths extending from an acoustic center of the acoustic beam to respective ones of the speaker units, the acoustic center being equal to the intersection determined by the second process for the speaker unit which is largest in terms of distance from the cover area, each path for an associated one of the speaker units being determined such as to pass through, in an order of longer to shorter distance from the cover area, all the intersections determined by the second process for those of the speaker units which are longer in the distance from the cover area than the associated one of the speaker units, and the fourth process can be for calculating the delay for each of the speaker units in accordance with a path difference between a shortest path among the paths determined by the third process and the path determined by the third process for each of the speaker units.

With the above arrangement, the paths are determined such that the distances from the acoustic center to the wavefronts of acoustic waves propagating along these paths are made equal to one another. The shorter the distance between the speaker unit and the target arrival position of the acoustic wave output therefrom, the larger the radiation angle of the acoustic wave will be. On the other hand, the longer the distance, the smaller the radiation angle will be. As a result, the envelope of the wavefronts of the acoustic waves at the same point of time is more distorted so as to face the target area as the envelope propagates closer to the target area. The delay between adjacent speaker units corresponds to a path difference between paths extending from the acoustic center to respective ones of these speaker units, and therefore acoustic waves output from the speaker units are made coincident in phase with each other.

The speaker units of the speaker array can be arranged on a plane, and the control unit can separately calculate a first delay and a second delay for each of the speaker units respectively in accordance with a vertical arrangement position and a horizontal arrangement position of each of the speaker units in the speaker array, can provide a sum of the first and second delays as the delay for each of the speaker units to the delay unit, and can carry out first to fourth processes, the first process can be for setting a cover area, which is a target arrival area of the acoustic beam, so as to cover the target area based on the area information and for setting target arrival points of the acoustic waves from the speaker units to the cover area in accordance with arrangement positions of the speaker units in the speaker array, the second process can be for classifying the speaker units into a plurality of virtual speaker lines in accordance with vertical arrangement positions of the speaker units in the speaker array and for determining virtual speaker units and target arrival points for the virtual speaker units, each virtual speaker unit being representative of speaker units belonging to each virtual speaker line, the second process being for determining intersections between first straight lines and second straight lines, each of the first straight lines passing though a corresponding one of the virtual speaker units and the target arrival point for the corresponding one of the virtual speaker units, each of the second straight lines passing through another corresponding one of the virtual speaker units, which is the largest next to the corresponding one of the virtual speaker units in terms of distance from the cover area, and the target arrival point for another corresponding one of the virtual speaker units, the third process can be for determining paths extending from an acoustic center of the acoustic beam to respective ones of the virtual speaker units, the acoustic center being equal to the intersection determined by the second process for the virtual speaker unit which is largest in terms of distance from the cover area, each path for an associated one of the virtual speaker units being determined such as to pass through all the intersections in an order of longer to shorter distance from the cover area, these intersections being determined by the second process for those of the virtual speaker units which are longer in the distance from the cover area than the associated one of the virtual speaker units, the fourth process can be for calculating the first delays for the speaker units belonging to each of the virtual speaker lines in accordance with path differences between a shortest path among the paths determined by the third process and the paths determined by the third process for the virtual speaker units corresponding to each of the virtual speaker line, and the control unit can determine the second delay for each of the virtual speaker lines in accordance with arrangement positions of the speaker units in each of the virtual speaker lines.

The speaker array system can include an adjustment unit that enables a user to adjust a shape or a size of the cover area or positions of the target arrival points in the cover area, and the control unit can calculate delays corresponding to respective ones of the plurality of speaker units in accordance with the cover area adjusted through the adjustment unit.

With this arrangement, the directivity characteristic of the acoustic beam emitted from the speaker array can be adjusted by means of an intuitive operation of adjusting the shape or size of the cover area or target positions in the cover area.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
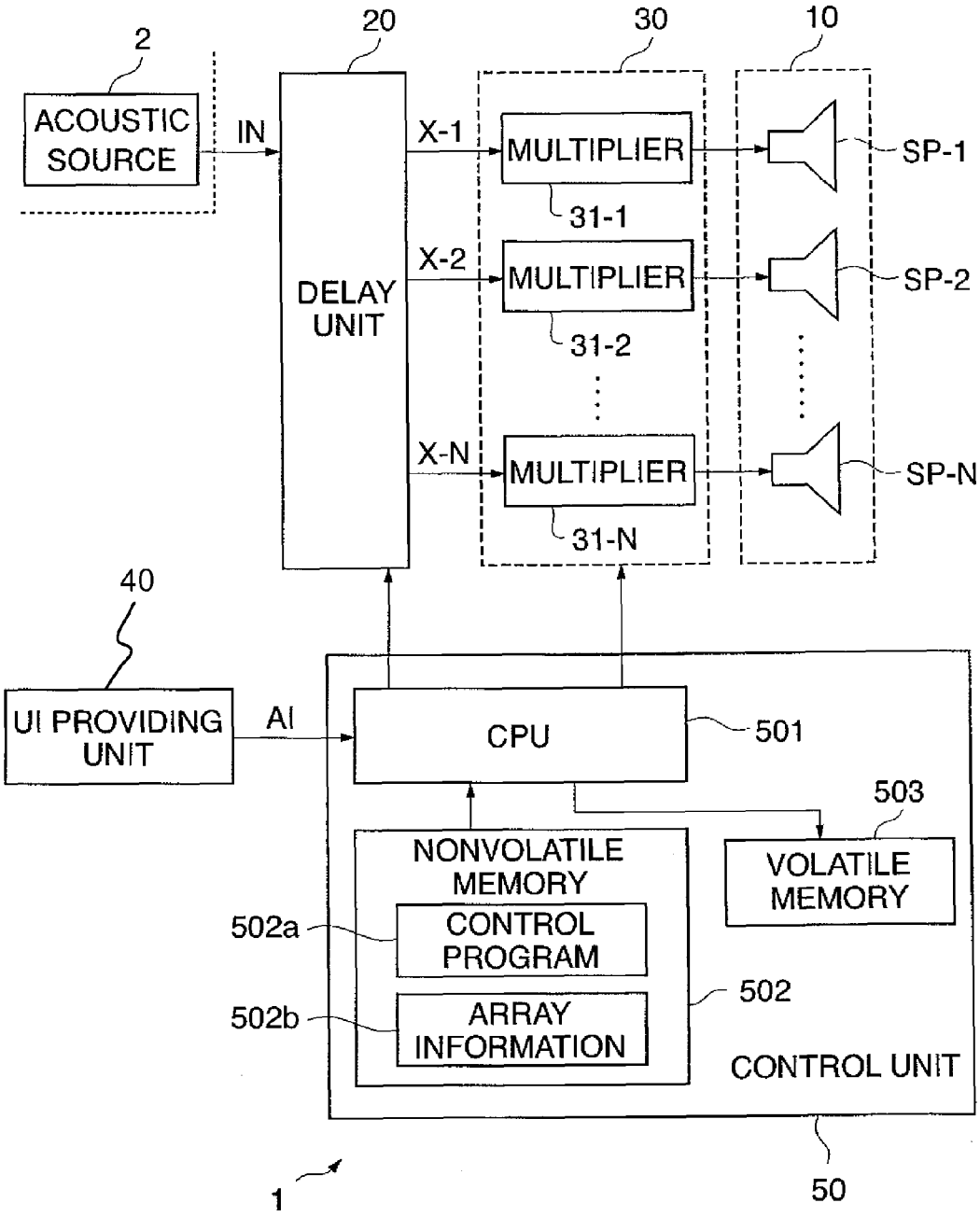
FIG. 1 is a view showing the construction of a speaker array system according to one embodiment of this invention.

FIG. 1 is a view showing an example of the construction of a speaker array system 1 according to one embodiment of this invention.

As shown in FIG. 1, the speaker array system 1 includes a speaker array 10, a delay unit 20, an amplification unit 30, a user interface providing unit (hereinafter referred to as the UI providing unit) 40, and a control unit 50.

Figure 2A:
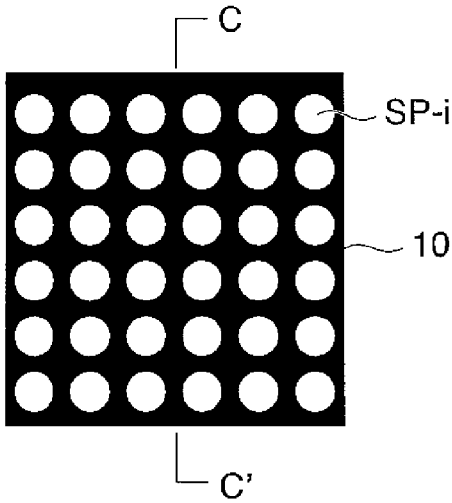
FIGS. 2A to 2C are front views of examples of how speaker units are arranged in a speaker array of the speaker array system.
Figure 2B:
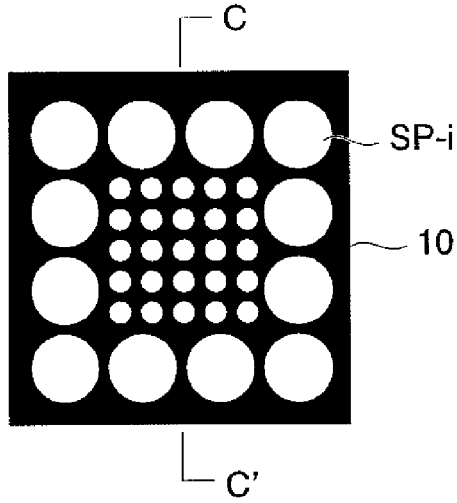
Figure 2C:
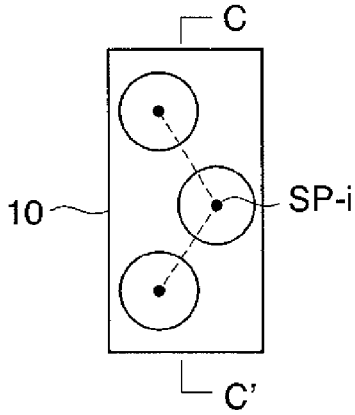

The speaker array 10 includes speaker units SP-i (i=1 to N, where N represents a natural number not less than 3). The speaker units SP-i are arranged such that speaker axes extend parallel to one another and a planar speaker surface (baffle surface) is formed. As mentioned above, a wavefront of an acoustic beam emitted from the speaker array 10 is formed by an envelope of wavefronts of acoustic waves output from the speaker units SP-i, the wavefronts being observed at the same point of time. Cone speakers or other speakers having a wide directivity may be used as the speaker units SP-i. The speaker array 10 may be constructed by speaker units SP-i having the same acoustic characteristic or a combination of different types of speaker units which are different in acoustic characteristic, e.g., in output frequency range. In the former case, the speaker array 10 may be formed by speaker units SP-i arranged in a matrix at equal intervals, as shown in FIG. 2A. In the latter case, the speaker array 10 may be formed for example by small-sized speaker units SP-i for high-frequency range arranged in a matrix and large-sized speaker units SP-i for low-frequency range arranged to surround the small-sized speaker units, as shown in FIG. 2B. Alternatively, as shown in FIG. 2C, the speaker array 10 may be formed by speaker units SP-i disposed at opposite ends and an apex of a polyline (dotted line in FIG. 2C). In the case of the speaker array 10 formed by planarly arranged speaker units SP-i, three or more speaker units SP-i must be arranged along at least one direction (the vertical direction in this embodiment) for the reason described later.

The delay unit 20 is a DSP (digital signal processor), for example. The delay unit 20 performs delay processing on an input audio signal IN supplied from an acoustic source 2 to thereby generate delayed audio signals X-i (i=1 to N) which are then supplied to the amplification unit 30. In a case that an analog signal is input from the acoustic source 2 as the input audio signal IN, it may be converted into a digital signal by an A/D converter before being supplied to the delay unit 20. In this embodiment, a so-called one-tap delay processing is implemented as the delay processing. The one-tap delay processing may be implemented by use of shift registers or a RAM (Random Access Memory). In the case of using a RAM, the delay unit 20 may perform processing in which the input audio signal IN is written into the RAM and the input audio signal IN is read out from the RAM upon elapse of time periods corresponding to the delays for the speaker units SP-i (i=1 to N) to thereby obtain delayed audio signals X-i to be supplied to the amplification unit 30. With this embodiment that generates the delayed audio signals X-i by the one-tap delay processing, the delay unit 20 can be formed by a smaller scale DSP than in a case that FIR (finite impulse response) type processing is carried out to generate the delayed audio signals.

As shown in FIG. 1, the amplification unit 30 includes multipliers 31-*i* (i=1 to N) respectively corresponding to the speaker units SP-i. The multipliers 31-*i* are supplied with the delayed audio signals X-i from the delay unit 20. The multipliers 31-*i* amplify the delayed audio signals X-i by multiplying them by predetermined coefficients supplied from the control unit 50. The delayed audio signals X-i output from the amplification unit 30 are converted into analog audio signals by a D/A converter (not shown in FIG. 1), which are respectively supplied to the speaker units SP-i.

Figure 3:
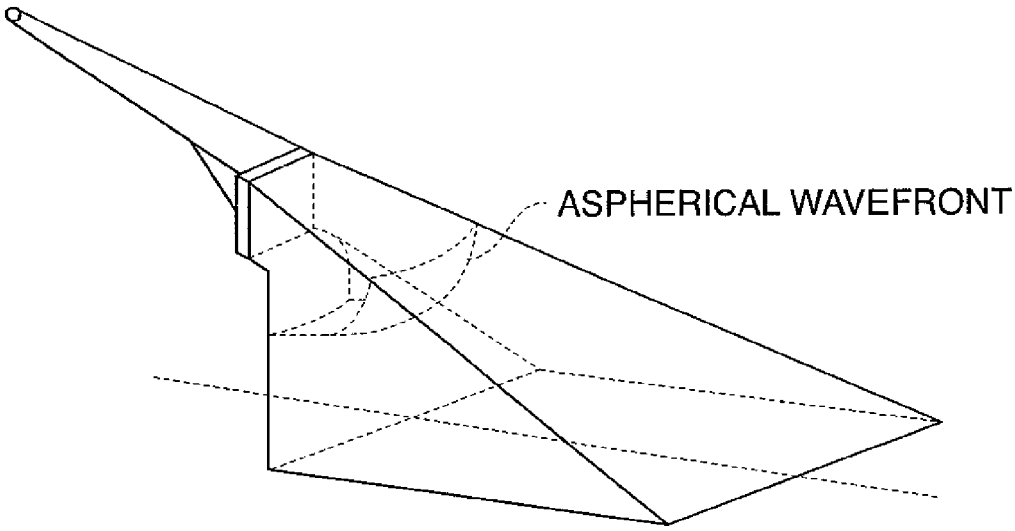
FIG. 3 is a view showing an example of how the wavefront of an acoustic beam emitted from the speaker array propagates.

The speaker array system 1 performs the delay array type directivity control, and the directional characteristic is determined based on the delays for the delayed audio signals X-i applied by the delay unit 20. With a conventional array system of delay array type for generating an acoustic beam having a spherical wavefront, an acoustic service with a small variation in sound pressure distribution can be provided, if a normal direction of an area for which the acoustic service is provided (hereinafter referred to as target area) is coincident with a normal direction of a speaker surface of a speaker array (i.e., in a case where the speaker surface of the speaker array faces the target area). However, if the normal direction of the target area is not coincident with that of the speaker surface, a variation occurs in sound pressure distribution in the target area. With the speaker array system 10 of this embodiment, on the other hand, an acoustic beam having an aspherical wavefront is emitted to a target area whose normal direction is not coincident with the normal direction of the speaker surface of the speaker array 10, thereby providing an acoustic service having a substantially uniform sound pressure distribution. As shown in FIG. 3, the aspherical wavefront indicates a wavefront which is more distorted such as to face the target area as the distance between the wavefront and the target area becomes shorter.

To make the wavefront of the acoustic beam emitted from the speaker array 10 to be an aspherical wavefront as shown in FIG. 3, the respective delays corresponding to the speaker units SP-i must be determined properly. As compared to generation of an acoustic beam having a spherical wavefront, the determination of such delays requires complicated calculations, requiring a laborious task, especially if it is performed by human calculations. To obviate this, the speaker array system of this invention is designed to be able to easily generate an acoustic beam having an aspherical wavefront shown in FIG. 3. Specifically, in the speaker array system 1 of this embodiment, such is achieved by the UI providing unit 40 and the control unit 50 in FIG. 1.

The UI providing unit 40 in FIG. 1 has a function of an input unit that enables a user to input various information representing a positional relation between the speaker array 10 and the target area, the shape and size of the target area (hereinafter referred to as the area information AI), and the sound volume in the target area (hereinafter referred to as the target sound volume). Based on the area information AI, the control unit 50 is for calculating delays to be applied to the delay unit 20, i.e., the delays D-i (i=1 to N) for use in generating an acoustic beam having an aspherical wavefront and directed to the target area represented by the area information AI and for applying the calculated delays to the delay unit 20. The control unit 50 is also for setting amplification rates (i.e., multiplier coefficients in the multipliers 31-*i*) that vary according to the target sound volume.

In the following, a detailed description will be given of the construction and function of the UI providing unit 40 and the control unit 50 by which this invention is characterized.

Figure 4:
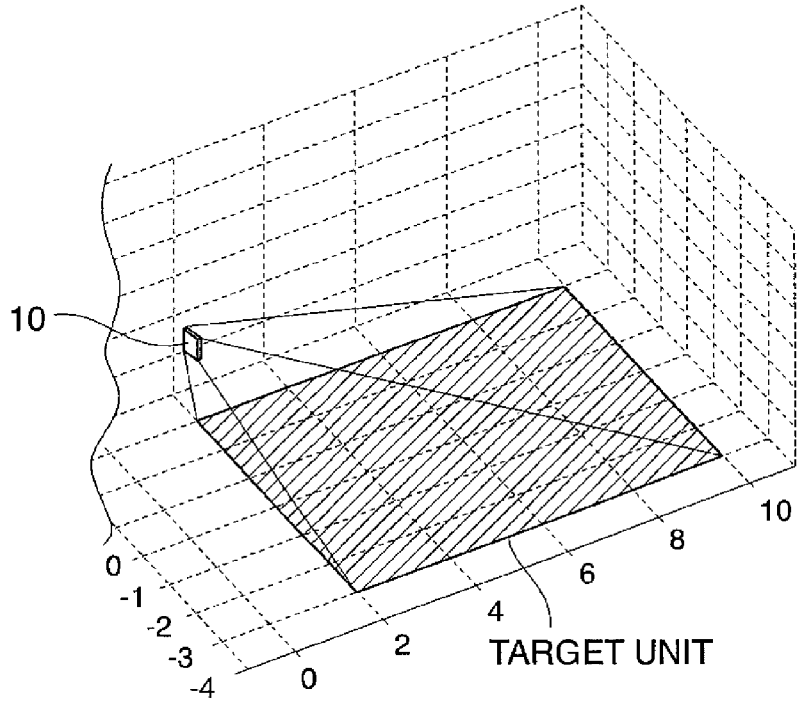
FIG. 4 is a view of an example of a target area set by a UI providing unit of the speaker array system.

In a concrete example, the UI providing unit 40 may include a display section (for example, a liquid crystal display) for displaying various input screens, a drive circuit for controlling the drive of the display section, and an operating section (such as for example, a keyboard and a mouse) for use by the user of the speaker array system 1 to input various information. The area information AI can be input in various forms. For example, in one form, coordinate values are input through the keyboard, which represent arrangement positions of the speaker array 10 and the target area in a three dimensional coordinate system set for a space such as concert hall in which the speaker array 10 and the target area are arranged. There is another form, in which the area information AI is input by a drag-and-drop operation using a pointing device while an image of a virtual three dimensional coordinate space as shown in FIG. 4 is displayed on the display section. The area information AI and the target sound volume input via the UI providing unit 40 as described above are supplied from the UI providing unit 40 to the control unit 50.

Figure 5:
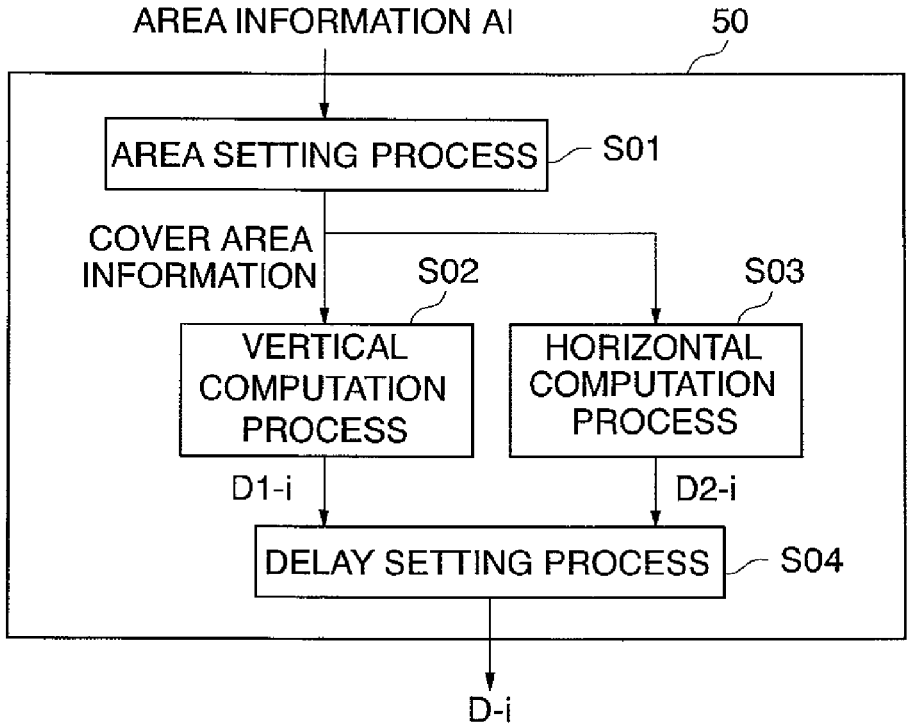
FIG. 5 is a view showing the flow of a delay computation process executed by a CPU of a control unit of the speaker array system.

As shown in FIG. 1, the control unit 50 includes a CPU (central processing unit) 501, a nonvolatile memory 502 such as a flash ROM, and a volatile memory 503 such as a RAM. In the nonvolatile memory 502, a control program 502*a* for causing the CPU 501 to execute a delay computation process by which the speaker array system of this invention is characterized is stored in advance along with array information 502*b*. The array information 502*b* is information representing the arrangement positions of the speaker units SP-i (i=1 to N) of the speaker array 10 in the speaker array 10. For example, the information represents coordinate positions of the speaker units SP-i in a two-dimensional coordinate system whose origin is at an upper left end of the speaker surface of the speaker array 10. The volatile memory 503 is utilized as a work area for use when the CPU 501 executes the control program 502*a*. As shown in FIG. 5, the delay computation process implemented by the CPU 501 in accordance with the control program 502*a* is divided into four processes, i.e., an area setting process S01, a vertical computation process S02, a horizontal computation process S03, and a delay setting process S04.

The following is a detailed description of the four processes.

Figure 6:
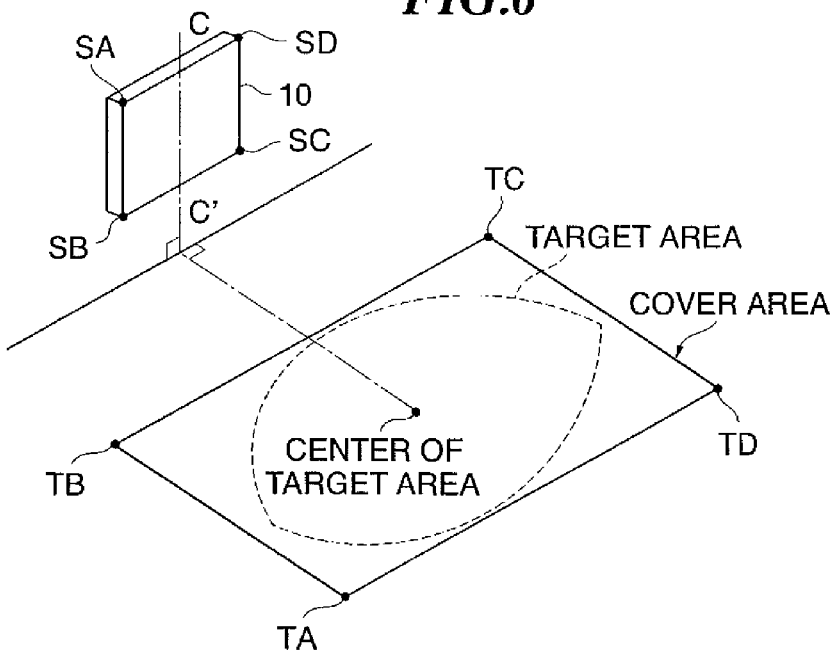
FIG. 6 is a view showing a relation between a target area and a cover area.

In the area setting process S01, a cover area, which is a target arrival area of an acoustic beam emitted from the speaker array 10, is set such as to cover the target area represented by the area information AI, and target arrival points of acoustic waves output from the speaker units SP-i to the cover area in accordance with the arrangement positions of the speaker units SP-i in the speaker array 10. For example, the UI providing unit 40 gives the area information AI that represents a target area whose center is on a crossline (shown by one-dotted chain line) between a horizontal plane and a vertical plane passing through a vertical center line of the speaker array 10 (line C-C' in FIGS. 2A to 2C) and whose normal line extends in a direction perpendicular to the normal direction of the speaker array 10, as shown in FIG. 6. In that case, a cover area is set, which is rectangular shape having two sides (TA-TD and TB-TC in FIG. 6) extending parallel to two parallel sides (SA-SD and SB-SC in FIG. 6) of the speaker array 10 and having a size large enough to cover the target area.

The positions of target arrival points in the cover area are geometrically determined based on a positional relation between the cover area and the speaker array 10, a length ratio between a horizontal side of the cover area and a horizontal side of the speaker array 10 (i.e., the length ratio between sides TA-TD and SA-SD), a length ratio between other sides thereof, and the arrangement positions of the speaker units SP-i represented by the array information 502*b*. Since the positions of the target arrival points in the cover area are determined in this manner, a geometrical relation in an arrangement of the target arrival points in the cover area is coincident with a geometrical relation in an arrangement of the speaker units SP-i in the speaker array 10 (for example, the speaker units are arranged in a lattice form). For example, the speaker units horizontally arranged at the speaker surface in a line are parallel to the target arrival points corresponding to the speaker units. For ease of subsequent calculations in the vertical computation process S02 and the horizontal computation process S03, the cover area is made rectangle in shape and the target arrival points are arranged in the cover area such that the geometrical relation in the arrangement of the speaker units SP-i in the speaker array 10 is also maintained between the target arrival points.

In the vertical computation process S02 to the delay setting process S04, the delays corresponding to the speaker units SP-i are computed such that an acoustic beam having an aspherical wavefront (see FIG. 3) is emitted to the cover area set by the area setting process S01. In the cover area to which the aspherical acoustic beam is emitted, an acoustic service with a substantially uniform sound pressure distribution can be realized. Since the target area indicated by the area information AI is covered by the cover area (see FIG. 6), the acoustic service with substantially uniform sound pressure distribution can also be attained in the target area.

In the vertical computation process S02, the delays (hereinafter referred to as the first delays) D1-*i* for the speaker units SP-i (i=1 to N) are computed in accordance with vertical arrangement positions of the speaker units SP-i at the speaker surface of the speaker array 10. In this vertical computation process S02, processing is carried out to divide the speaker units SP-i of the speaker array 10 into groups in accordance with the vertical arrangement positions of the speaker units SP-i indicated by the array information 502*b* in order to reduce an amount of computation. Specifically, speaker units SP-i which are the same in vertical arrangement position are grouped into one group. Speaker units SP-i belonging to each group have the same vertical arrangement position. Thus, the first delays D1-*i* for all the speaker units SP-i can be calculated by computing the first delays by the number of the groups.

Figure 7:
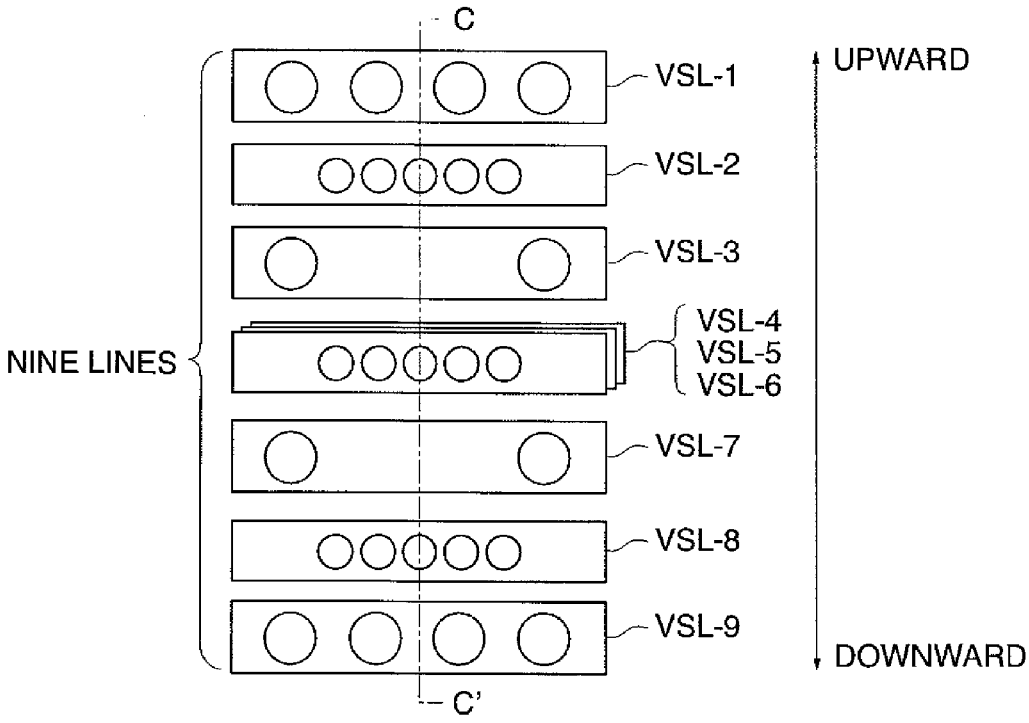
FIG. 7 is a view showing an example of virtual speaker lines which are set by a vertical computation process S02.

Speaker units SP-i belonging to each group are the same in vertical arrangement position in the speaker array 10 and therefore arranged on a horizontal line (in line). In the following, respective groups of speaker units are referred to as the virtual speaker lines VSL-j. The affix "j" indicates the line number of each virtual speaker line counted from the uppermost speaker line on the speaker surface of the speaker array 10. In a case for example that the speaker units SP-i are arranged in a matrix form as shown in FIG. 2A, the virtual speaker lines VSL-j are coincident with respective ones of actual speaker lines of the speaker array 10 as viewed in the vertical direction. If the speaker units SP-i are arranged in the form shown in FIG. 2B, they are classified into nine virtual speaker lines VSL-j (j=1 to 9) as shown in FIG. 7. If arranged in the form shown in FIG. 2C, they are classified into three virtual speaker lines VSL-j (j=1 to 3).

Next, in the vertical computation process S02, a speaker unit representative of the speaker units SP-i belonging to each virtual speaker line VSL-j is determined. In this embodiment, to simplify calculations in the subsequent processes, a speaker unit positioned at the center of the speaker units belonging to each virtual speaker line VSL-j (i.e., a speaker unit located on the line C-C' in FIG. 7) is selected as a representative speaker unit of the speaker units SP-i belonging to the virtual speaker line VSL-j. For a virtual speaker line having no speaker unit located at the center thereof as in the case of the virtual speaker lines VSL-1, VSL-3, VSL-7 and VSL-9 shown in FIG. 7, it is supposed that there is a speaker unit at the center of such a virtual speaker line, and the thus supposed speaker unit is determined as the representative speaker unit of the speaker units SP-i belonging to the virtual speaker line. In the following, the representative speaker unit of the speaker units SP-i belonging to the virtual speaker line VSL-j will be referred to as the "virtual speaker unit VSP-j", irrespective of whether the representative speaker unit is an actual one or an imaginary one. Next, based on the virtual speaker unit VSP-j and the target arrival point TP-j for the virtual speaker unit VSP-j, the CPU 501 calculates the first delay D1-*i* for the virtual speaker unit VSP-j in accordance with the following procedures.

Figure 8A:
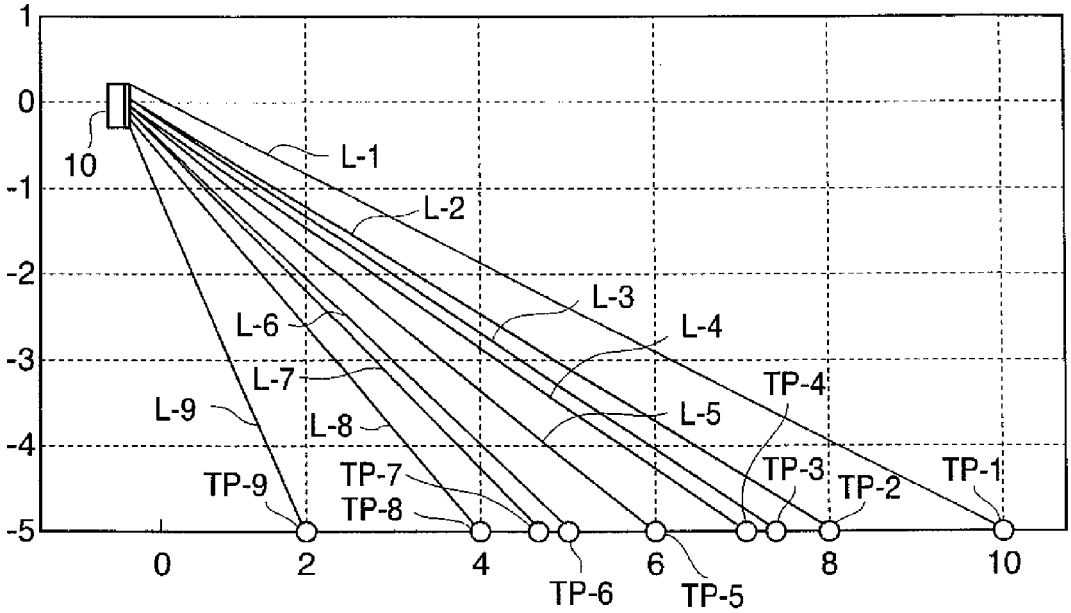
FIGS. 8A and 8B are views for explaining the processing content of the vertical computation process S02.
Figure 8B:
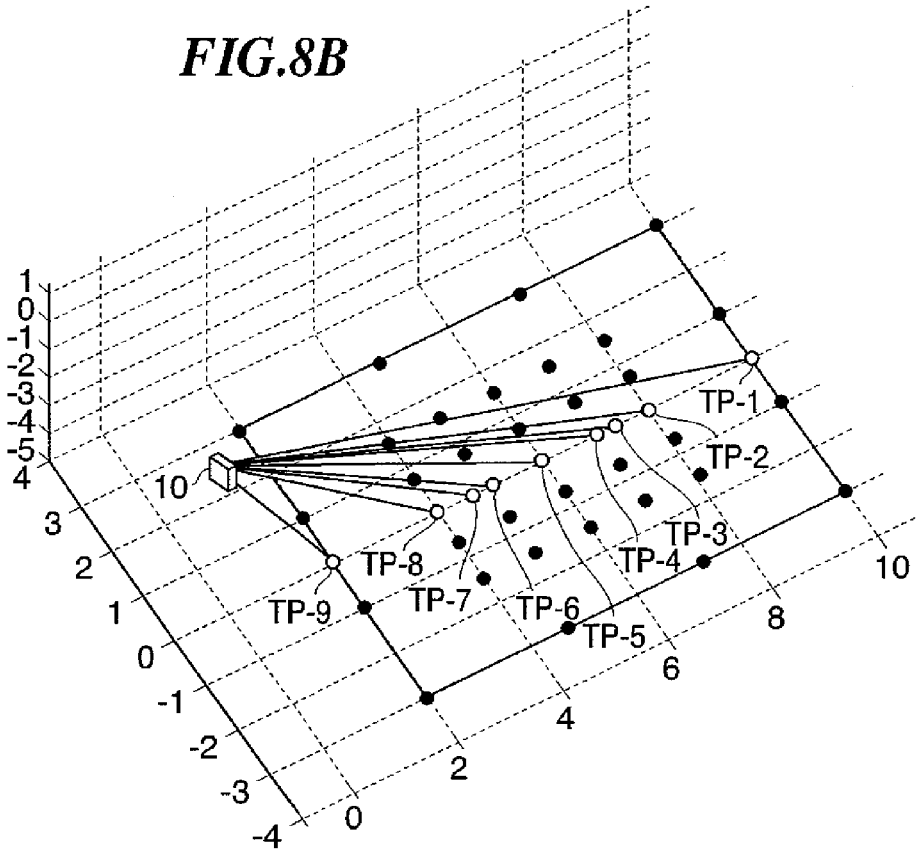

Specifically, the CPU 501 determines coordinates of intersections. At each intersection Kjm, a straight line L-j passing through the virtual speaker unit VSP-j and the corresponding target arrival point TP-j crosses a straight line L-m passing through the virtual speaker unit VSP-m (m=j+1 (ditto in the following)), which is the largest next to the virtual speaker unit VSP-j in terms of the distance from the cover area and passing through the target arrival point TP-m. In a case for example that the speaker array 10 is configured as shown in FIG. 2B, the speaker units SP-i of the speaker array 10 are divided into nine groups of virtual speaker lines VSL-j. In that case, nine straight lines L-j passing through respective ones of nine virtual speaker units VSP-j and corresponding target arrival points TP-j in the cover area are plotted as shown in FIGS. 8A and 8B, and coordinates of eight intersections K12 to K89 are determined as shown in FIGS. 9A and 9B.

Figure 9A:
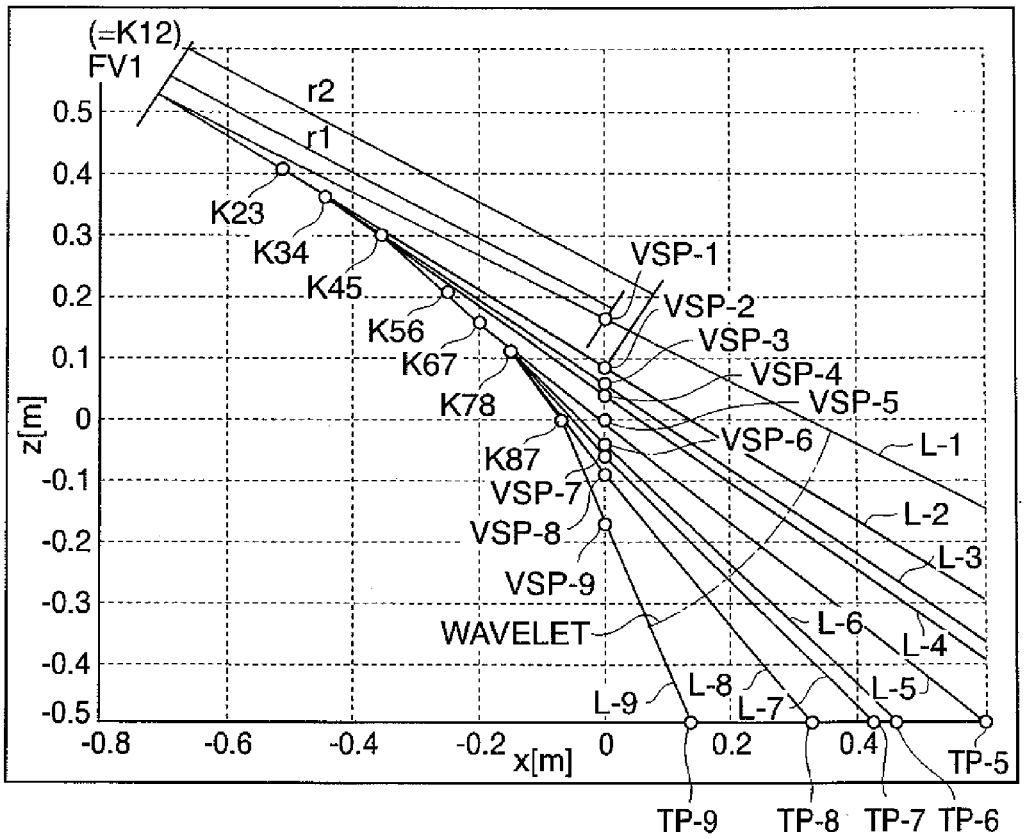
FIGS. 9A and 9B are views for explaining the processing content of the vertical computation process S02.
Figure 9B:
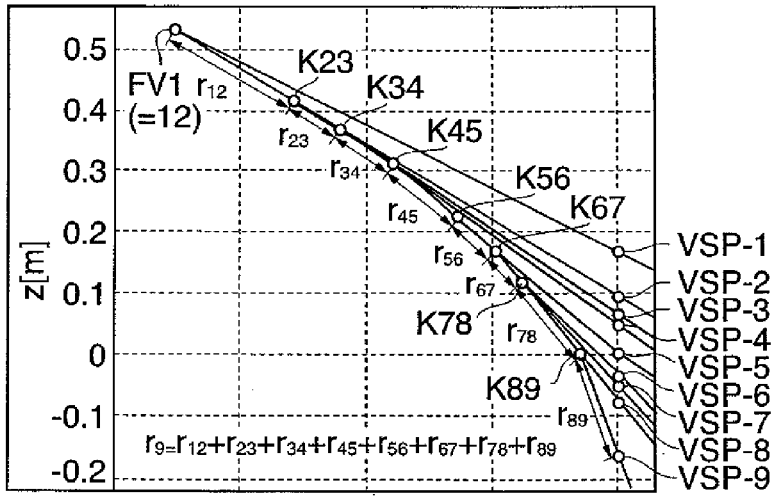

Next, the CPU 501 determines paths extending to the virtual speaker units VSP-j, using the intersection (i.e., intersection K12) determined for the virtual speaker unit which is largest in the distance from the cover area (i.e., virtual speaker unit VSP-1) as an acoustic center FV1 of the acoustic beam emitted to the target area, as shown in FIG. 9A. Specifically, the CPU 501 carries out the process to determine the path from the acoustic center to each virtual speaker unit VSP-j such that the path passes through, in the order of longer distance to shorter distance from the cover area, all the intersections determined by the above process for those virtual speaker units which are longer in the distance from the cover area than the virtual speaker unit VSP-j.

For example, as shown in FIG. 9A, a path r1 for the virtual speaker unit VSP-1 extending along a straight line L-1 from the acoustic center FV1 to the virtual speaker unit VSP-1 is determined, and a path r2 for the virtual speaker unit VSP-2 extending along a straight line L-2 from the acoustic center FV1 to the virtual speaker unit VSP-2 is determined. A path for the virtual speaker unit VSP-3 extending from the acoustic center FV1 via the intersection K23 to the virtual speaker unit VSP-3 is determined. Similarly, paths respectively extending to the virtual speaker units VSP-4 to VSP-8 are determined. As shown in FIG. 9B, a path r9 (=r12+r23+r34+r45+r56+r67+r78+r89) for the virtual speaker unit VSP-9 extending from the acoustic center FV1 via intersections K23, K34, . . . , K89 to the virtual speaker unit VSP-9 is determined. Symbol r12 represents the distance between intersections K12 and K23, and symbol r23 represents the distance between intersections K23 and K34. Each of symbols r34 to r78 similarly represents the distance between corresponding intersections. Symbol r89 represents the distance between the intersection K89 and the virtual speaker unit VSP-9. Thus, the paths extending from the acoustic center FV1 to respective ones of the virtual speaker units VSP-j are determined, which are refracted paths along which the acoustic beam propagates while being refracted at the intersections. It is noted that in the case of the speaker array 10 having only two speaker units SP-i juxtaposed in the vertical direction, the paths determined by the above described procedures (i.e., the paths extending from the acoustic center to these two speaker units SP-i) are the same as paths calculated by the conventional delay array system for generating an acoustic beam having a spherical wavefront. In this regard, the speaker array 10 of the speaker array system 1 of this embodiment must have three or more speaker units SP-i arranged in the vertical direction.

Next, the CPU 501 calculates a delay for each virtual speaker unit VSP-j based on a path difference between the shortest path (r1 in this embodiment) among the paths determined as described above and the path determined for the virtual speaker unit VSP-j. The delay is calculated, for example, by dividing the path difference by the sound velocity. The delay calculated for each virtual speaker unit VSP-j is used as the first delays D1-*i* for the speaker units SP-i which have the same vertical arrangement position as that of the virtual speaker unit VSP-j.

The determined first delays D1-*i* are added to the input audio signal IN to thereby generate delayed audio signals X-i, which are supplied to the speaker units SP-i. As a result, distances between the acoustic center FV1 and wavefronts of acoustic waves output from the speaker units SP-i and then propagating along the paths are made to be the same as one another without regard to the paths. In addition, the shorter in the distance from the cover area the speaker unit SP-i from which the acoustic wave is output, the larger the aperture angle (i.e., radiation angle) of the wavefront of the acoustic wave will be. Thus, the envelope of wavefronts of the acoustic waves output from the speaker units SP-i is more distorted so as to face the cover area as the envelope propagates closer to the cover area. Furthermore, the first delays D1-*i* for two speaker units SP-i adjacent to each other in the vertical direction of the speaker array 10 have a delay difference corresponding to the path difference between the paths from the acoustic center FV1 to these two speaker units. Thus, acoustic waves respectively output from the two groups of speaker units SP-i are made to be coincident in phase at the same point of time with each other.

Next, a description will be given of the horizontal computation process S03. The horizontal computation process S03 is for calculating delays (hereinafter referred to as the second delays) D2-*i* for the speaker units SP-i (i=1 to N) in accordance with horizontal arrangement positions of the speaker units at the speaker surface of the speaker array 10. In this horizontal computation process S03, the following processing is performed on each of the virtual speaker lines VSL-j, thereby calculating the second delays D2-*i* for the speaker units SP-i belonging to the virtual speaker line VSL-j. Specifically, straight lines passing through the speaker units SP-i belonging to each virtual speaker line VSL-j and the corresponding target arrival points are determined, and an intersection of these straight lines is determined as a horizontal focus for the virtual speaker line VSL-j. Then, the second delays D2-*i* for the speaker units SP-i belonging to the virtual speaker line VSL-j are calculated in accordance with path differences between paths extending from the determined focus to these speaker units SP-i.

Figure 10A:
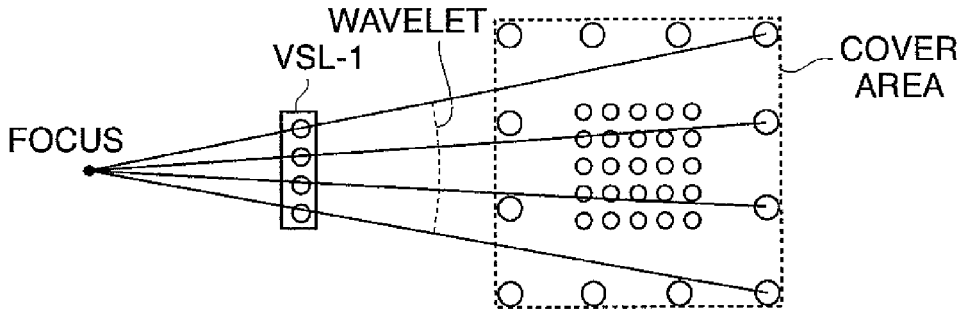
FIGS. 10A through 10C are views for explaining the processing content of a horizontal computation process S03.
Figure 10B:
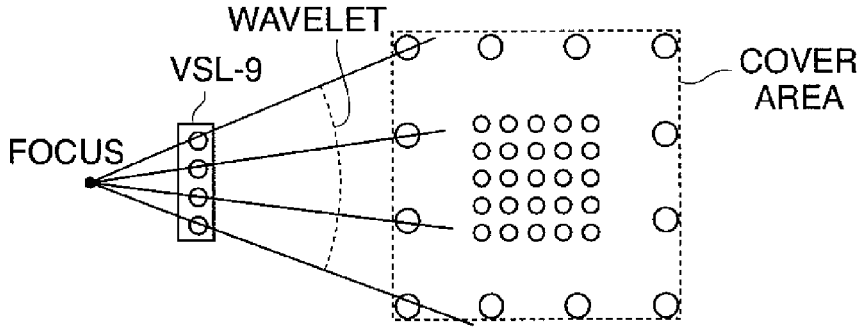
Figure 10C:
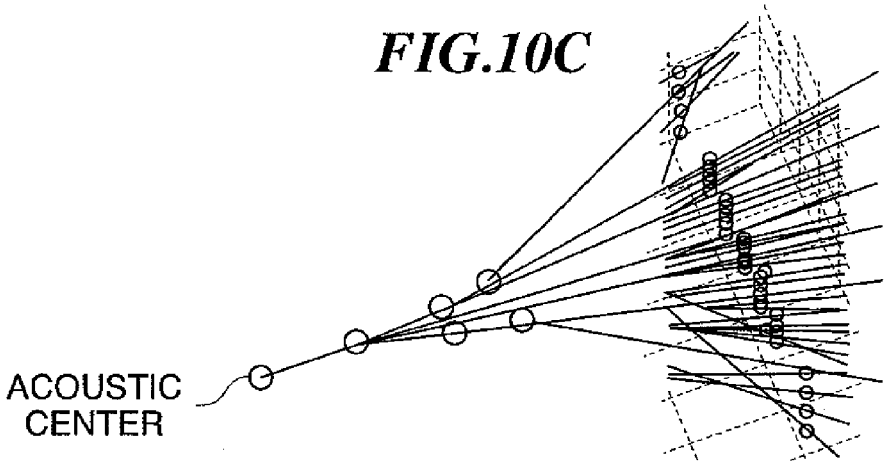

FIG. 10A shows the focus and the paths for the speaker units SP-i belonging to the virtual speaker line VSL-1 in FIG. 7 (i.e., the virtual speaker line located at the uppermost part of the speaker surface), and FIG. 10B shows the focus and paths for the speaker units SP-i belonging to the virtual speaker line VSL-9 in FIG. 7 (i.e., the virtual speaker line located at the lowermost part of the speaker surface). By adding the second delays D2-*i* corresponding to the determined path differences to the input audio signal IN, delayed audio signals X-i are generated. As shown in FIGS. 10A and 10B, the longer in the distance of the virtual speaker line from the cover area, the narrower the horizontal aperture angle (i.e., horizontal radiation angle) of the envelope of acoustic waves emitted from the virtual speaker line will be. The shorter in the distance of the virtual speaker line from the cover area, the wider the aperture angle of the envelope of acoustic waves emitted therefrom will be. It should be noted that processing similar to that in the vertical computation process S02 may be performed in the horizontal computation process S03. In that case, as shown in FIG. 10C, refracted paths extending from one acoustic center to the respective speaker units SP-i are determined, and the second delays D2-*i* are determined in accordance with differences between these paths.

Figure 11:
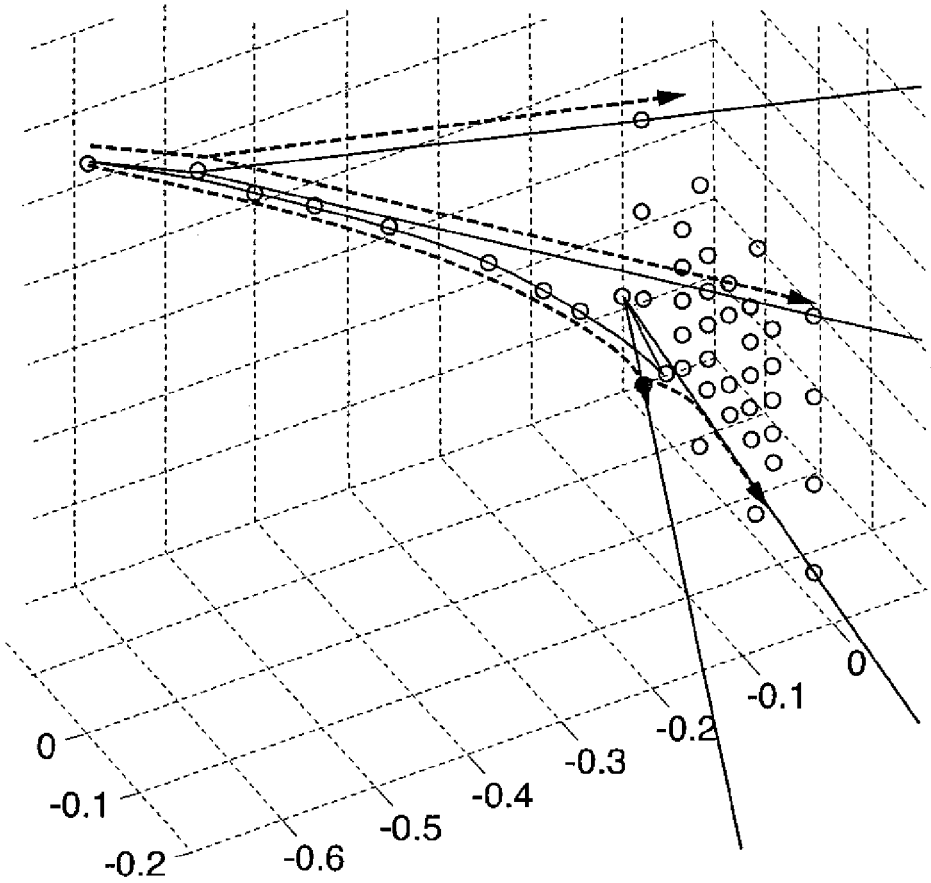
FIG. 11 is a view showing how acoustic waves emitted from the speaker array propagate.

In the delay setting process S04, sums of the first delays D1-*i* and the second delays D2-*i* calculated as described above for the speaker units SP-i (i=1 to N) are applied to the delay unit 20 as the delays D-i for the speaker units SP-i. It is noted that since each virtual speaker line VSL-j is in parallel to a line of the target arrival points for the speaker units SP-i belonging to the virtual speaker line VSL-j, the horizontal focus determined for the virtual speaker line VSL-j as described above is on the vertical plane passing through line C-C'. In other words, the focuses for the virtual speaker lines and the above described intersections are present on the same plane. Therefore, the envelope of wavefronts, observed at the same point of time, of acoustic waves output from the speaker units SP-i of the speaker array 10 is two-dimensionally represented, and an acoustic beam formed by the acoustic waves propagates as shown by arrows in FIG. 11.

As described above, according to the speaker array system 1 of this embodiment, the acoustic beam having an aspherical wavefront shown in FIG. 3 is emitted from the speaker array 10 toward the target area designated by the user, and it is therefore possible to realize an acoustic service with substantially uniform sound volume in the target area. This embodiment is also characterized in that the delays for attaining the acoustic beam are calculated based on the positional relation between the speaker array 10 and the target area and the shape and size of the target area, and therefore the user is not required to perform a complicated calculation operation, etc. Since the delay process performed by the delay unit 20 of the speaker array system 1 of this embodiment is a one-tap delay process, the delay unit 20 can be formed by a small scale DSP and the speaker system 1 can be simplified in construction.

In the above, there has been described one embodiment of this invention, which may be modified variously as described below.

First Modification

Figure 12A:
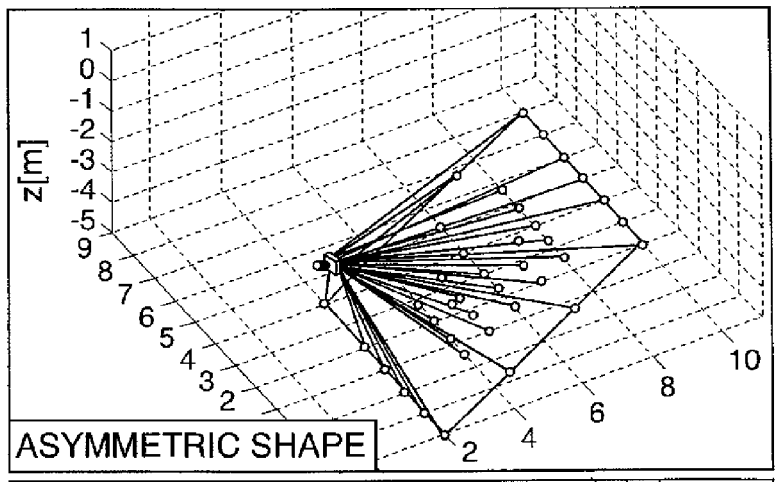
FIGS. 12A through 12C are views showing a form of setting of the cover area according to a first modification.
Figure 12B:
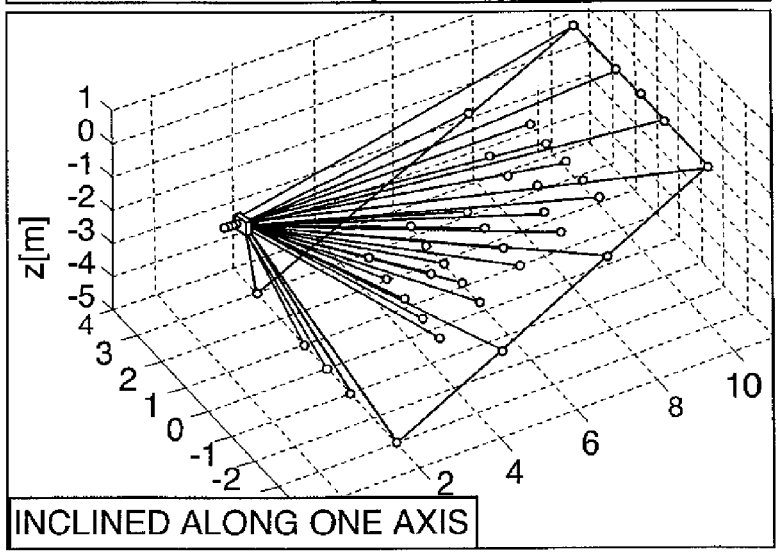
Figure 12C:
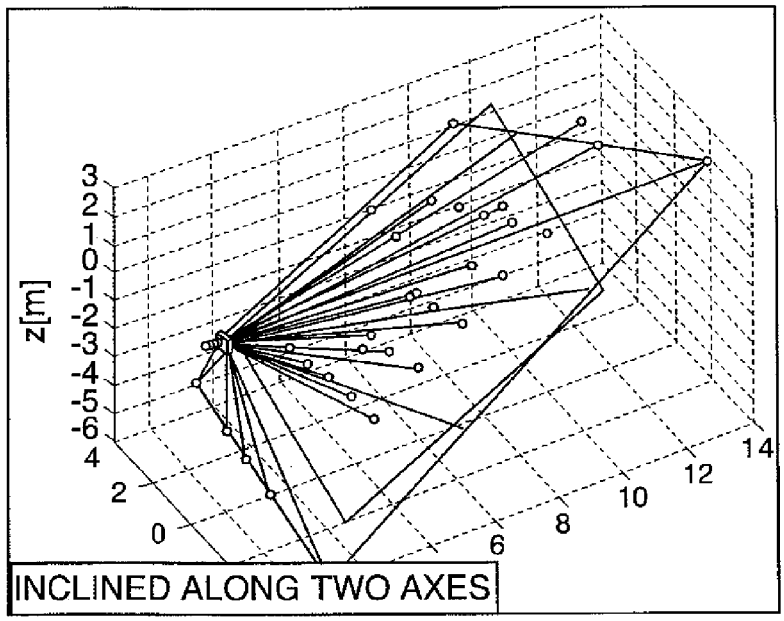

In the above described embodiment, the delays for the speaker units SP-i are determined by designating a target area to be on a plane whose normal line extends in a direction perpendicular to a normal direction of the speaker surface of the speaker array 10, by setting a rectangular cover area so as to cover the target area, and by determining target arrival points for the speaker units SP-i such that the geometrical relation in the arrangement of the speaker units SP-i is also maintained between the target arrival points. However, the shape of the cover area is not limited to rectangle, but may be an asymmetric shape as shown in FIG. 12A. The target area may be designated to be on a plane inclined along one or two axial directions relative to the horizontal plane as shown in FIGS. 12B and 12C, and a cover area may be set so as to cover the target area. In brief, the delays for the speaker units SP-i can be determined with use of the same algorithm as that for the vertical and horizontal computation processes S02, S03 provided that the target arrival points for the speaker units SP-i are set in the cover area while maintaining the geometrical relation in the arrangement of the speaker units.

Second Modification

Figure 13A:
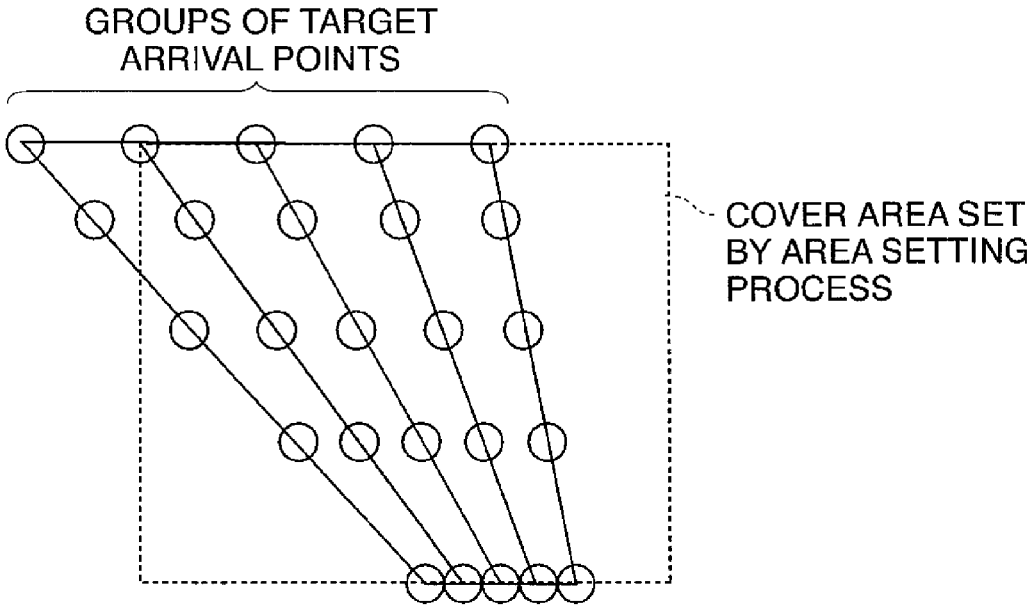
FIGS. 13A and 13B are views for explaining an adjustment unit according to a second modification.
Figure 13B:
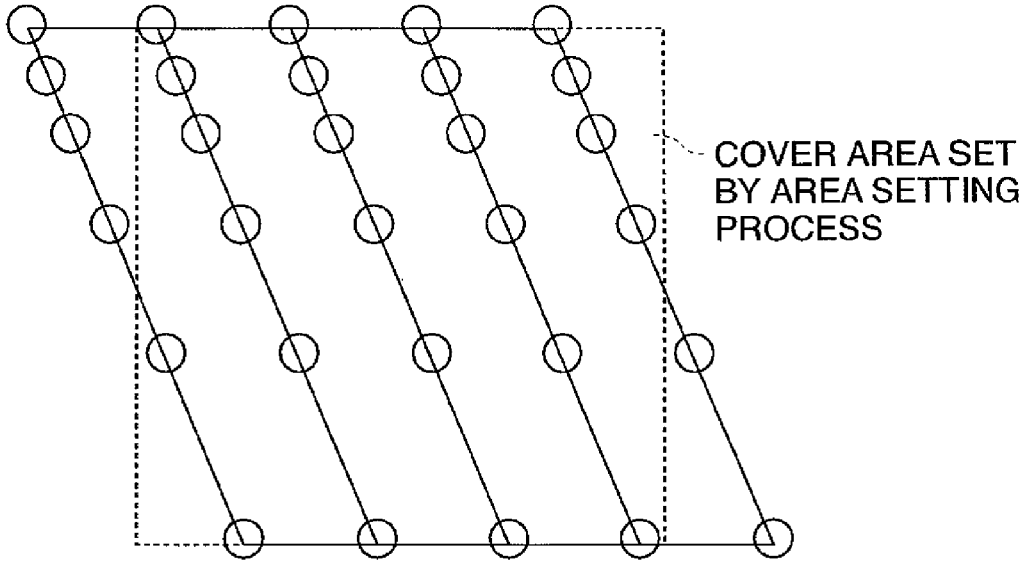

In the embodiment, the rectangular cover area is set so as to cover the target area designated by a user, and the delays for the speaker units SP-i are determined based on a positional relation between the cover area and the speaker array 10 and the size of the cover area. In setting the delays for the speaker units, however, the size of the cover area may appropriately be adjusted, and the shape of the cover area may be deformed into a trapezoid having a width which becomes narrower toward the side close to the speaker array 10 and becomes wider toward the side away from the speaker array 10, as shown for example in FIG. 13A. Alternatively, as shown in FIG. 13B, there may be provided an adjustment unit for changing distances between target arrival point groups respectively corresponding to virtual speaker lines, and the adjusted cover area is subjected to the above described delay computation process to determine the delays corresponding to the speaker units SP-i. The UI providing unit 40 can be used as the adjustment unit. With the adjustment unit, a fine adjustment to make the center of a sound pressure distribution to be more coincident with the center of the target area in a high-frequency range than in a low-frequency range for improvement of the sound pressure distribution around a frequency band much affecting audibility or other fine adjustment can be intuitively carried out through the medium of the shape of the cover area.

Third Modification

Figure 14:
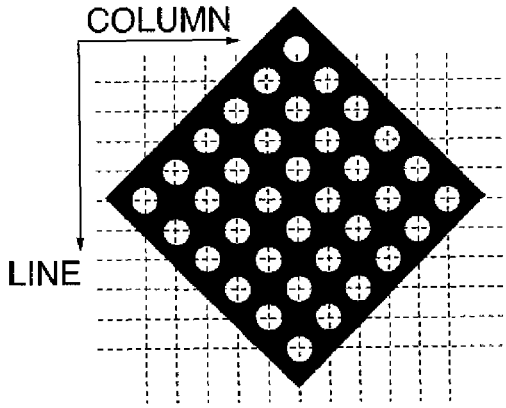
FIG. 14 is a view for explaining virtual speaker lines according to a third modification.
Figure 15:
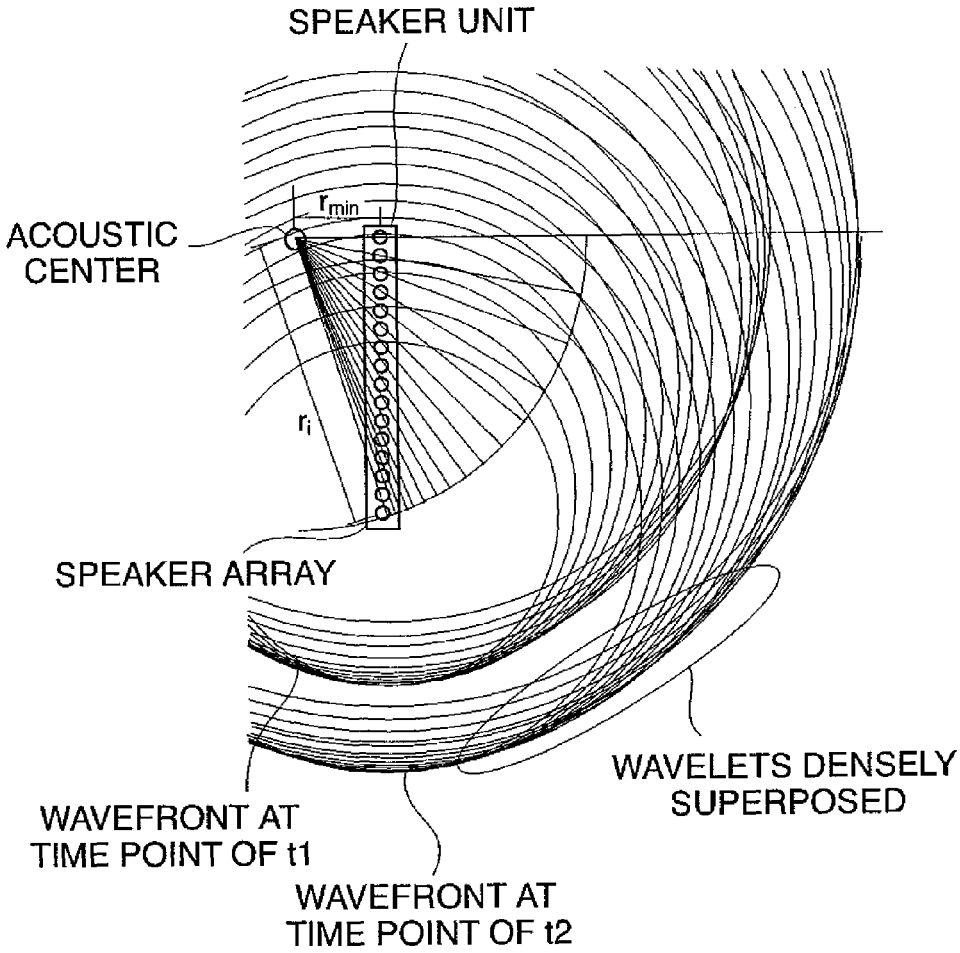
FIG. 15 is a view for explaining problems of a conventional speaker array of delay array type.

In the embodiment, the virtual speaker lines are formed in accordance with the vertical arrangement positions of the speaker units SP-i of the speaker array 10. Depending on the positional relation between the target area and the speaker surface of the speaker array 10, with such grouping, the center of the sound pressure distribution cannot be made coincident with the center of the target area in some cases. Thus, depending on the positional relation between the target area and the speaker surface of the speaker array 10, a virtual line direction and a virtual column direction may be determined as shown for example in FIG. 14, and virtual speaker lines may be formed by speaker units SP-i arranged in the virtual line direction. Then, delays in the virtual column direction may be determined by the vertical computation process S02, and delays in the virtual line direction may be determined by the horizontal computation process S03.

Fourth Modification

In the embodiment, this invention is applied to a two-dimensional speaker array in which a plurality of speaker units are arranged to form a planar speaker surface. However, this invention is applicable to a speaker array in which a plurality of speaker units are arranged to form a curved speaker surface. This invention is also applicable to a one-dimensional speaker array in which a plurality of speaker units are arranged on a line, i.e., a speaker array in which speaker units are arranged on a straight line on a flat or curved plane. In applying this invention to this kind of a one-dimensional speaker array, either the vertical computation process S02 or the horizontal computation process S03 may be implemented to calculate delays respectively corresponding to the speaker units.

Fifth Modification

In the embodiment, the delays to be applied to the delay unit 20 are calculated by the CPU 501 in accordance with the arrangement position and size of the target area. However, delays may be calculated in advance for target areas having different sizes and different arrangement positions, for example, and the calculated delays may be stored in the nonvolatile memory 502 so as to correspond to information representing the sizes and arrangement positions of the target areas. When the size and arrangement position of a target area are designated by a user, the CPU 501 may carry out processing to read corresponding delays from the nonvolatile memory 502 and supply the delays to the delay unit 20.

Sixth Modification

In the embodiment, there is set only one cover area that covers the target area designated by a user. However, cover areas having different sizes and shapes may be set for respective frequency ranges, and delays for these frequency ranges may be calculated. When the same delay amount is used in controlling a high-frequency range and a low-frequency range, the sound pressure distribution for the low-frequency range, for which it is difficult to perform directivity control, is liable to be spread out as compared to that for the high-frequency range, producing a deviation in the sound pressure distribution for the entire frequency range. To obviate this, a cover area for high-frequency range may be set so as to be wider than that for low-frequency range, for example, whereby the sound pressure distribution for the entire frequency range can nearly be uniform in the target area.

Seventh Modification

In the embodiment, the control program 502*a* for causing the CPU 501 of the control unit 50 to implement the delay computation process by which the speaker array system of this invention is characterized is stored in advance in the nonvolatile memory of the control unit 50. However, the control program 502*a* may be stored for distribution in a CD-ROM (compact disk-read only memory) or other computer-readable recording medium, or may be able to be downloaded for distribution via the Internet or other electronic communication line. The thus distributed control program 502*a* may be stored into an ordinary computer and the computer may be operated to function as the control unit 50.

For example, the distributed control program 502*a* may be stored into a nonvolatile memory such as a hard disk of a personal computer (hereinafter referred to as PC). Functions of the control unit 50 may be allocated to the CPU, volatile memory, and nonvolatile memory of the PC, and functions of the UI providing unit 40 may be allocated to the display section and operating section of the PC, thereby making it possible for the PC to control delays in the delay unit 20 of an ordinary speaker array apparatus of delay array type (an apparatus having the speaker array 10, the delay unit 20, and the amplification unit 30). With this arrangement, the speaker array system of this invention can be configured by a combination of the ordinary speaker array apparatus of delay array type and the ordinary PC.

What is claimed is:

1. A speaker array system comprising:

a speaker array comprising a plurality of speaker units arranged in an array;

a delay unit adapted to add delays respectively corresponding to the speaker units to an input audio signal to generate delayed audio signals corresponding in number to the speaker units and adapted to supply the delayed audio signals to the speaker units;

an input unit adapted for inputting area information representing a target area to which an acoustic service is to be provided using an acoustic beam generated by acoustic waves output from the speaker units, the target area having a normal line extending in a direction different from a normal direction of a speaker surface of said speaker array; and a control unit adapted to provide the delays to said delay unit based on positions of the speaker units in said speaker array and the area information, wherein said control unit controls the delays to allow an envelope of wavefronts of the acoustic waves output from the speaker units to have an aspherical configuration, to allow the acoustic waves output from adjacent ones of the speaker units in said speaker array toward the target area to be coincident in phase with each other, and to allow the envelope to become more aspherical, to face the target area, as the envelope propagates closer to the target area.

2. The speaker array system according to claim 1, wherein:

the speaker units of said speaker array are arranged in a line, and said control unit carries out first to fourth processes as follows:

the first process is for setting a cover area, which is a target arrival area of the acoustic beam, to cover the target area based on the area information and for setting target arrival points of the acoustic waves from the speaker units to the cover area in accordance with arrangement positions of the speaker units in said speaker array, the second process is for determining intersections between first straight lines and second straight lines, each of the first straight lines passing though the arrangement position and the target arrival point for a corresponding one of the speaker units, each of the second straight lines passing through the arrangement position and the target arrival point for another corresponding one of the speaker units that is the largest next to the corresponding one of the speaker units in terms of distance from the cover area, the third process is for determining paths extending from an acoustic center of the acoustic beam to respective ones of the speaker units, the acoustic center being equal to the intersection determined by the second process for the speaker unit that is largest in terms of distance from the cover area, each path for an associated one of the speaker units being determined to pass through, in an order of longer to shorter distance from the cover area, all the intersections determined by the second process for those of the speaker units that are longer in the distance from the cover area than the associated one of the speaker units, and the fourth process is for calculating the delay for each of the speaker units in accordance with a path difference between a shortest path among the paths determined by the third process and the path determined by the third process for each of the speaker units.

3. The speaker array system according to claim 1, wherein:

the speaker units of said speaker array are arranged on a plane, said control unit separately calculates a first delay and a second delay for each of the speaker units respectively in accordance with a vertical arrangement position and a horizontal arrangement position of each of the speaker units in said speaker array, provides a sum of the first and second delays as the delay for each of the speaker units to said delay unit, and carries out first to fourth processes as follows:

the first process is for setting a cover area, which is a target arrival area of the acoustic beam, to cover the target area based on the area information and for setting target arrival points of the acoustic waves from the speaker units to the cover area in accordance with arrangement positions of the speaker units in said speaker array, the second process is for classifying the speaker units into a plurality of virtual speaker lines in accordance with the vertical arrangement positions of the speaker units in said speaker array and for determining virtual speaker units and target arrival points for the virtual speaker units, each virtual speaker unit being representative of speaker units belonging to each virtual speaker line, the second process being for determining intersections between first straight lines and second straight lines, each of the first straight lines passing though a corresponding one of the virtual speaker units and the target arrival point for the corresponding one of the virtual speaker units, each of the second straight lines passing through another corresponding one of the virtual speaker units that is the largest next to the corresponding one of the virtual speaker units in terms of distance from the cover area, and the target arrival point for said another corresponding one of the virtual speaker units, the third process is for determining paths extending from an acoustic center of the acoustic beam to respective ones of the virtual speaker units, the acoustic center being equal to the intersection determined by the second process for the virtual speaker unit that is largest in terms of distance from the cover area, each path for an associated one of the virtual speaker units being determined such as to pass through all the intersections in an order of longer to shorter distance from the cover area, the intersections being determined by the second process for those of the virtual speaker units that are longer in the distance from the cover area than the associated one of the virtual speaker units, and the fourth process is for calculating the first delays for the speaker units belonging to each of the virtual speaker lines in accordance with path differences between a shortest path among the paths determined by the third process and the paths determined by the third process for the virtual speaker units corresponding to each of the virtual speaker line, and said control unit determines the second delay for each of the virtual speaker lines in accordance with arrangement positions of the speaker units in each of the virtual speaker lines.

4. The speaker array system according to claim 2, further including:

an adjustment unit that enables a user to adjust a shape or a size of the cover area or positions of the target arrival points in the cover area, wherein said control unit calculates the delays corresponding to respective ones of the plurality of speaker units in accordance with the cover area adjusted through said adjustment unit.

5. The speaker array system according to claim 3, further including:

an adjustment unit that enables a user to adjust a shape or a size of the cover area or positions of the target arrival points in the cover area, wherein said control unit calculates the delays corresponding to respective ones of the plurality of speaker units in accordance with the cover area adjusted through said adjustment unit.

* * * * *